United States Patent [19]

Hobson

[11] Patent Number: 4,566,746

[45] Date of Patent: Jan. 28, 1986

[54] ELECTRICAL CONNECTOR

[75] Inventor: Ervin J. Hobson, Chicago, Ill.

[73] Assignee: Hobson Bros., Inc., Chicago, Ill.

[21] Appl. No.: 617,398

[22] Filed: Jun. 5, 1984

[51] Int. Cl.[4] ..... H01R 11/22

[52] U.S. Cl. ..... 339/60 R; 339/61 R; 339/143 R; 339/252 R

[58] Field of Search ..... 339/60 R, 61 R, 103 R, 339/143, 252, 14, 258 R

[56] References Cited

U.S. PATENT DOCUMENTS

| | | | |
|---|---|---|---|
| 3,486,162 | 12/1969 | Leitmann | 339/61 |
| 3,784,952 | 1/1974 | Murray | 339/12 V |
| 4,155,614 | 5/1979 | Hall | 339/143 R |
| 4,191,973 | 3/1980 | Szydlowski | 358/245 |
| 4,204,741 | 5/1980 | Hall | 339/200 P |
| 4,326,096 | 4/1982 | Leitmann | 174/84 R |
| 4,343,526 | 8/1982 | Hobson et al. | 339/90 R |
| 4,382,650 | 5/1983 | Herrmann, Jr. | 339/97 R |
| 4,387,947 | 6/1983 | Lostumo et al. | 339/90 R |

*Primary Examiner*—Gil Weidenfeld
*Assistant Examiner*—Paula A. Austin
*Attorney, Agent, or Firm*—Neuman, Williams, Anderson & Olson

[57] ABSTRACT

A high-voltage circuit electrical connector is provided having a clip with protruding elements for resiliently making electrical contact with a terminal fixedly mounted on a surface. The clip includes a bail section interconnecting the protruding elements. A bare conductor end portion of an insulated electrical lead is disposed between the clip protruding elements and is resiliently sandwiched between the clip bail section and a portion of a shield member so that electrical contact is made between the bare conductor end portion and the clip bail section. The shield member is provided with openings through which the clip protruding elements extend. The clip, the shield member and the bare conductor end portion are accommodated within a cover piece of insulative material. The cover piece includes an inner skirt section which encompasses the clip protruding elements and overlies and resiliently engages the portion of the surface circumjacent the terminal. The cover piece also includes an outer section provided with an interior cavity having an open side adjacent the skirt section. An opening is formed in the outer section and is provided with an inner end communicating with the cavity and through which the bare conductor end portion of the electrical lead extends. The opposite end of the opening is exposed and an insulated segment of the lead adjacent the bare conductor end portion projects outwardly therefrom. The cavity is provided with a protuberance which engages the periphery of the shield member and retains the latter in contact with the bare conductor end portion.

14 Claims, 12 Drawing Figures

FIG. 4
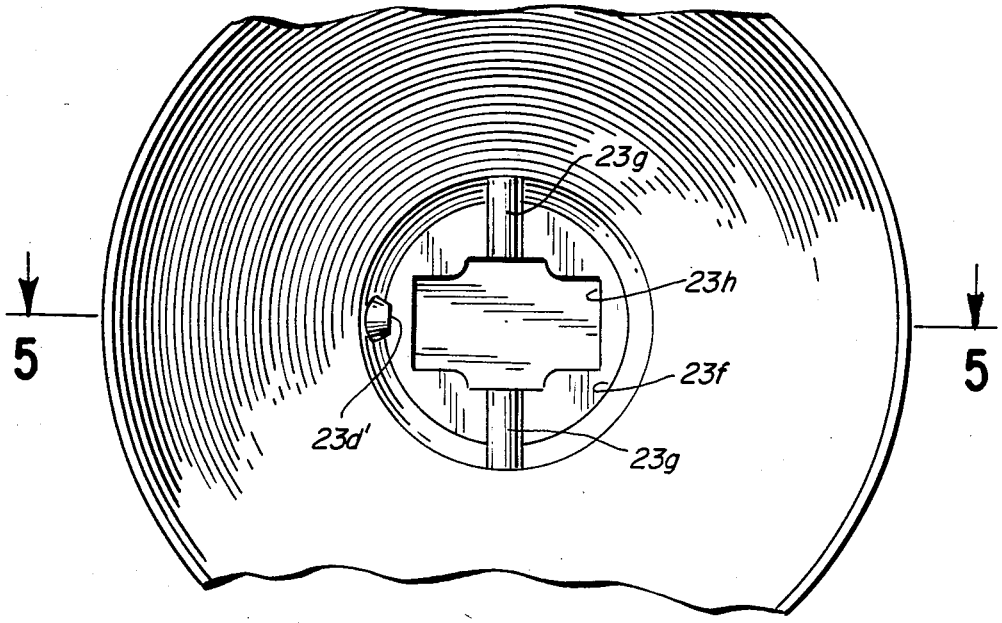
FIG. 5
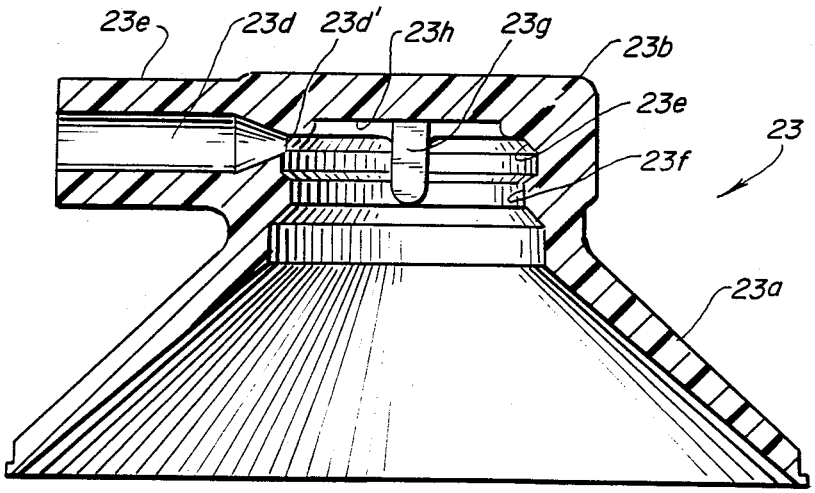
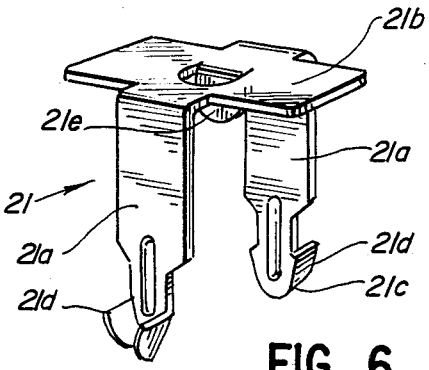
FIG. 6
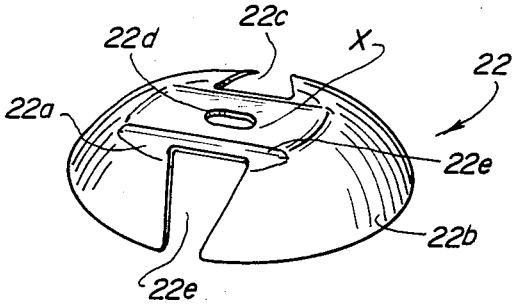
FIG. 7

FIG. 8
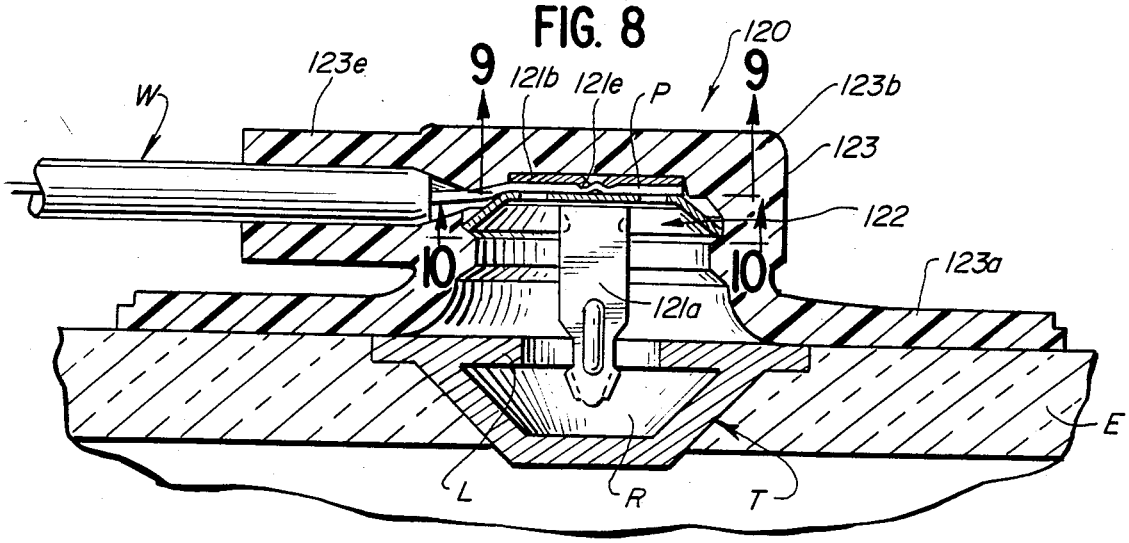
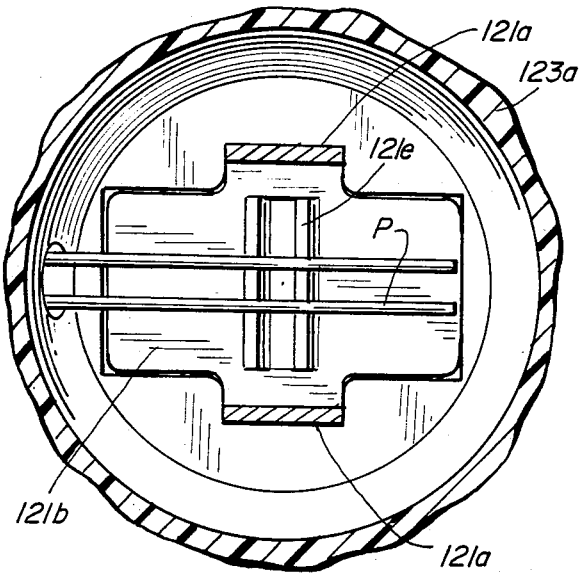
FIG. 9
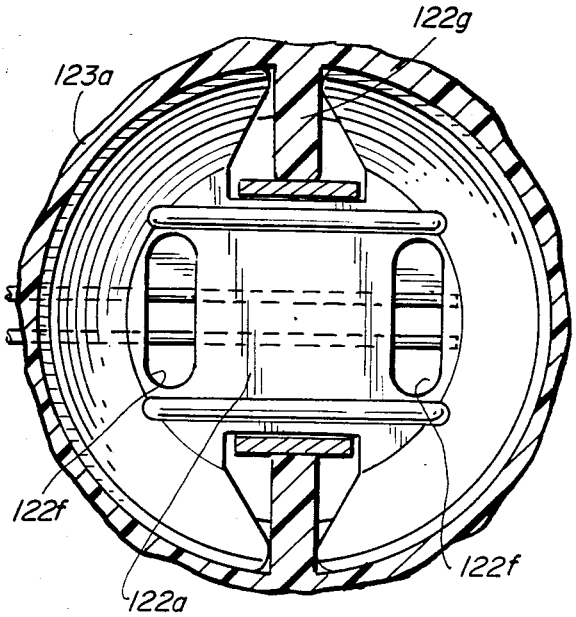
FIG. 10
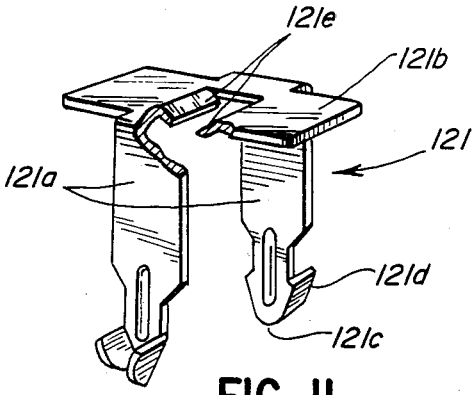
FIG. 11
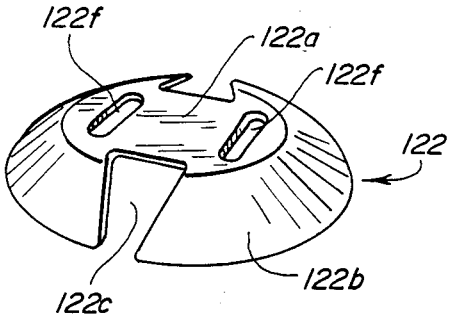
FIG. 12

ELECTRICAL CONNECTOR

BACKGROUND OF THE INVENTION

In various projection-type television receivers and video display units wherein a terminal is embedded in the envelope of a cathode ray tube, it is important that the anode connector make proper contact with the terminal so as to avoid serious electrical shock hazards and corona problems. Various connectors have heretofore been utilized which overcome the aforenoted problems; however, because of certain inherent design characteristics they are beset with one or more of the following shortcomings: (a) they have a high profile thereby restricting their use to a limited number of installations where there is ample clearance around the tube exterior surface; (b) they are awkward and difficult to manually attach to or remove from the terminal; (c) the insulated electrical lead for the connector must have either a bare conductor end portion which is crimped or soldered to a component of the connector, or the insulative covering of the lead must be pierced by a pointed prong forming a part of the connector; thus, frequently resulting in a faulty electrical contact; (d) the components of the connector are retained in assembled relation by a screw or rivet, thereby complicating the assembly of the components; and (e) the connector is of fragile and costly construction and embodies an inordinate number of component parts.

SUMMARY OF THE INVENTION

Thus, it is an object of the invention to provide an improved electrical connector which effectively overcomes the aforenoted problems associated with prior connectors of this general type.

It is a further object to provide an improved electrical connector which embodies a minimum number of simple, inexpensive components which may be readily assembled.

It is a further object to provide an improved electrical connector which will maintain proper electrical contact with the terminal even when subjected to excessive vibrations.

It is a still further object to provide an electrical connector wherein no soldering, crimping or piercing of the insulation is required to make a good electrical contact between an insulated electrical lead and a component of the connector.

Further and additional objects will appear from the description, accompanying drawings and appended claims.

In accordance with one embodiment of the invention an electrical connector is provided for use in making electrical contact with a terminal in a high-voltage circuit. The terminal is embedded in a surface and is provided with a recess and a lip which delineates an entry to the recess. The connector includes a clip of electrical conductive material, a shield member, and a cover piece of insulative material in which the clip and shield member are disposed. The clip is provided with a pair of elongated protruding elements having exposed ends which extend into the terminal recess and make resilient electrical contact with the entry-forming lip. The opposite ends of the elements are interconnected by a bail section. The shield member has a portion thereof which coacts with the clip bail section to resiliently sandwich therebetween a bare conductor end portion of an insulated electrical lead. The cover piece includes an inner skirt section which encompasses the clip protruding elements and is adapted to resiliently engage the portion of the surface which is circumjacent the terminal. Integral with the skirt section is an outwardly extending outer section which is provided with an interior cavity having an open side adjacent the skirt section. The outer section is provided with an opening having a restricted inner end communicating with the cavity and through which only the bare conductor end portion will pass. The outer end of the opening is exposed and sized to accommodate a segment of the insulated electrical lead. The cavity is provided with a protuberance which is spaced from the opening inner end and engages the periphery of the shield member and retains the latter in coacting relation with the clip bail section.

DESCRIPTION

For a more complete understanding of the invention reference should be made to the drawings wherein:

FIG. 1 is a fragmentary, perspective top view showing one embodiment of the improved connector assembled with a terminal embedded in the exterior surface of a conventional cathode ray tube or the like.

FIG. 4 is an enlarged fragmentary view of the cover piece per se looking from the skirt section into the cavity of the outer section.

FIG. 5 is an enlarged sectional view taken along line 5—5 of FIG. 4.

FIG. 6 is an enlarged perspective view of the clip per se shown in FIG. 2.

FIG. 7 is an enlarged perspective view of the shield member per se shown in FIG. 2.

FIG. 8 is similar to FIG. 2 but of a second embodiment of the improved connector.

FIGS. 9 and 10 are enlarged fragmentary sectional views taken respectively along lines 9—9 and 10—10 of FIG. 8.

FIG. 11 is an enlarged perspective view of the clip per se shown in FIG. 8 with a portion of one protruding element cutaway at the juncture of the element with the bail section.

FIG. 12 is an enlarged perspective view of the shield member per se shown in FIG. 8.

Figure 1:
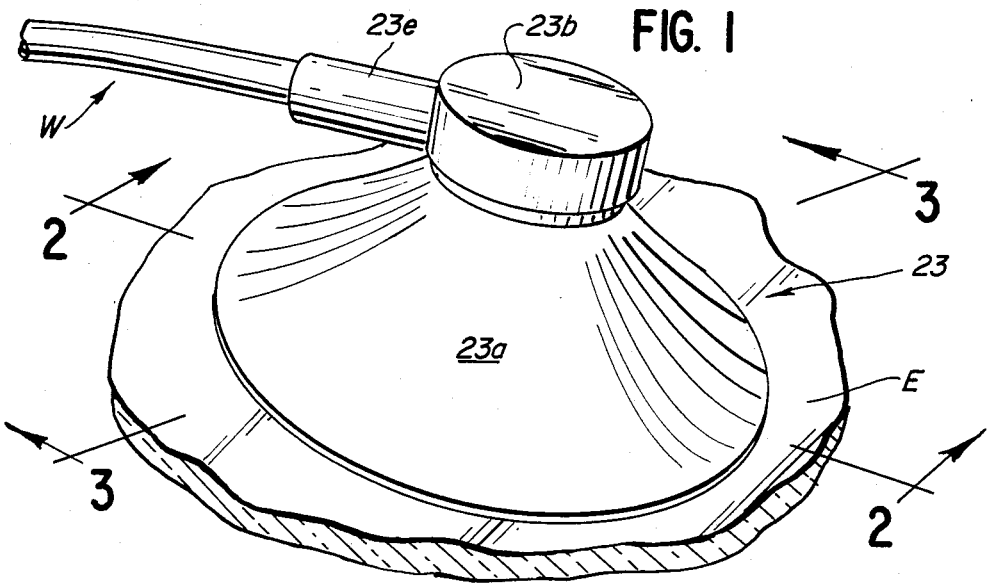
Figure 2:
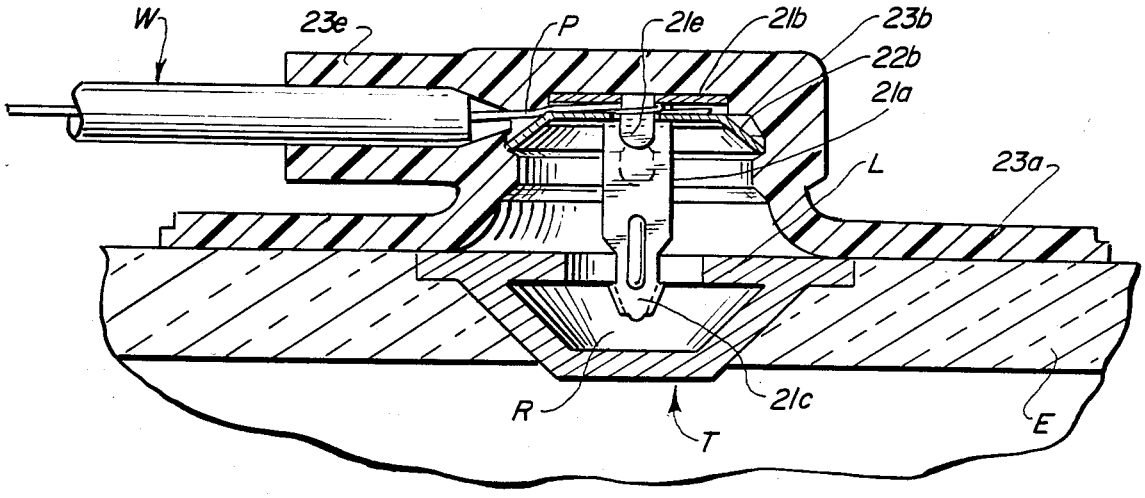
FIG. 2 is an enlarged, fragmentary sectional view taken along line 2—2 of FIG. 1.
Figure 3:
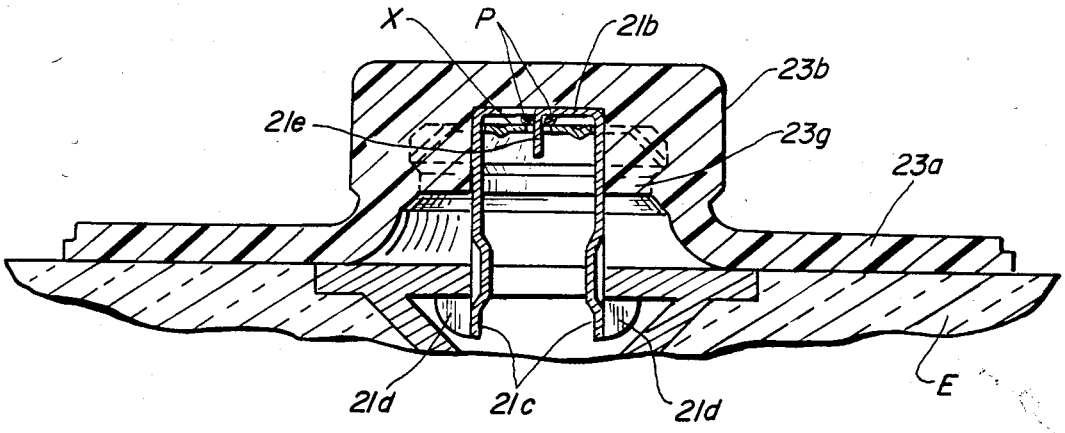
FIG. 3 is an enlarged fragmentary sectional view similar to FIG. 2 but taken along line 3—3 of FIG. 1.

Referring now to the drawings and more particularly to FIG. 1-3, one embodiment of the improved connector is shown connected to a terminal T which is of conventional design. The terminal is fixedly mounted on or embedded in the glass envelope E of a cathode ray tube utilized in a variety of equipment (e.g. projection type television; word processor CRT display). In such installations it is not uncommon for the circuit to have a voltage of approximately 28,000-30,000 volts where the projected image is in color, or approximately 22,000 volts where the projected image is in black and white. With such voltages, care must be exercised to avoid corona problems; the hazard of electrical shock and the problem of arc out to other components.

The terminal T, as illustrated, is provided with a recess R which is accessible through an entry delineated by an inwardly extending lip L. The terminal is normally located on the side of the envelope and spaced rearwardly from the exposed face of the tube, not shown. Because of the disposition of the tube within a cabinet or frame, not shown, oftentimes there is only limited clearance in the vicinity of the terminal with the result that only a connector with a low profile can be used. In this regard the improved connector to be hereinafter described has a low profile thereby enabling it to be utilized in a significantly greater number of installations.

The connector includes a clip of thin spring metal or other suitable conductive material. The clip, as seen more clearly in FIG. 6, has an inverted, substantially U-shape configuration with a pair of protruding elements or legs 21*a* which depend from a bail section 21*b*. The legs have the free ends 21*c* thereof shaped so that they can pass through the terminal entry when they are manually pressed towards one another a predetermined amount. Once the free ends 21*c* clear the terminal lip L and are disposed within the terminal recess R, the ends 21*c* when released, will resiliently snap outwardly into interlocking engagement with the lip and make a positive electrical contact therewith. Each leg end 21*c* is provided with a pair of outwardly offset ears 21*d* which prevent disengagement of the connector from the terminal except when the free ends are once again manually pressed towards one another a sufficient amount so as to allow the ears 21*d* to clear the lip when the connector is withdrawn from the terminal.

In addition to clip 21, the connector 20 is provided with a shield member 22 which preferably has an inverted substantially saucer-like configuration, see FIG. 7. The shield member may be formed of the same material as the clip or of some other suitable material (e.g., cold-rolled steel 25 mils thick and electro-tin plated). The shield member has a base portion 22*a* which is delineated by an angularly offset rim portion 22*b*. The rim and base portions are provided with a pair of open end apertures 22*c* which are sized to accommodate the clip legs 21*a* when the shield member is assembled with the clip, see FIGS. 2 and 3. The segment X of the base portion 22*a*, which is disposed between apertures 22*c*, coacts with the bail section 21*b* so as to sandwich or wedge therebetween a bare conductor end portion P of a conventional insulated electrical lead or wire W, as will be described more fully hereinafter.

As will be noted in FIG. 6, the bail section 21*b* of the clip 21 is provided with a depending protuberance or tab 21*e* which may be struckout from the bail section. The protuberance 21*e* is centered relative to the legs 21*a* and is adapted to be encircled or looped by the bare conductor end portion P of the lead W.

As seen in FIG. 7 the segment X of the base portion 22*a* of the shield member 22 is provided with an opening 22*d* through which the protuberance 21*e* of the clip extends. To provide added stiffness to segment X, a pair of elongated reinforcing ribs 22*e* arranged in parallel spaced relation are formed in the base portion, see FIG. 7.

The clip 21 and shield member 22 are disposed within a cover piece 23 which may be molded from dielectric material (e.g., silicone rubber). As seen in FIG. 5, the cover piece 23 includes a conically shaped inner skirt section 23*a* and an outwardly extending outer section 23*b*. The sections are integral with one another and the skirt section 23*a* is adapted to encompass the depending clip legs 21*a* and, when the connector is assembled with the terminal T, the skirt section will be distorted and resiliently engage the exposed surface portion circumjacent the terminal, see FIGS. 2 and 3.

The outer section 23*b* is provided with an interior cavity 23*a* having an open side adjacent the skirt portion. Disposed to one side of the cavity is an opening 23*d* which is formed in a tubular projection 23*e* extending laterally from the outer section 23*b*. The inner end 23*d'* of the opening 23*d*, which communicates with the cavity, is restricted so that only the bare conductor end portion P of the insulated lead W will pass therethrough. The remainder of the opening is sized to slidably accommodate an insulated portion of the lead which is adjacent the end portion P.

The interior cavity 23*c* is provided with an inwardly extending protuberance or ledge 23*f*. The ledge in the illustrated embodiment has an annular configuration and is disposed between the opening inner end 23*d'* and the open side of the cavity adjacent the skirt section 23*a*. The ledge 23*f* is adapted to engage the outer periphery of the shield member rim portion 22*b* and retain the base portion segment X in snug engagement with the bare conductor end portion disposed between the clip legs 21*a*.

The interior cavity 23*a* is also provided with a pair of diametrically opposed inwardly extending lugs 23*g*. The lugs are accommodated within the open end apertures 22*c* of the shield member when the latter is assembled within the cavity 23*c*. The lugs prevent relative rotation of the shield member 22 within the cavity and facilitate pushing of the clip onto the anode button or connector. To effect greater stability of the clip 21 within the cavity 23*c*, the latter may be provided with a surface recess 23*h* which is opposite the cavity open side and is sized to accommodate the clip bail section 21*b*.

FIGS. 8–13 illustrate a second embodiment of the improved connector 120 which is similar to the connector shown in FIG. 2 except for the configuration of certain portions of the clip 121 and shield member 122. Components of connector 120 which correspond to those of the connector of FIG. 2 will be identified by the same number but in a 100 series.

As shown in FIG. 11, the clip 121 has replaced the struckout protuberance 21*e* with tines 121*e* which are formed from the bail section 121*b* and project downwardly a short distance. The free end of each tine is relatively sharp and thus, makes positive electrical contact with the bare conductor end portion P when the shield number 122 (FIG. 12) is properly assembled with the clip 121 and cover piece 123. An advantage of connector 120 is that the bare conductor end portion is not required to encircle or loop around the protuberance 21*e*.

To be assured that the bare conductor end portion P has been properly located so as to extend across the clip tines 121*e*, the shield member 122 is provided with a second set of openings 122*f* which are located on opposite sides of the tines when the shield member is in coacting relation with the clip 121 whereby the bare conductor end portion sandwiched between the clip bail section 121*b* and the base portion 122*a* of the shield member 122 can be seen through the openings 122*f* when the interior of the connector is observed from the the skirt section side, see FIG. 10. In the illustrated embodiment 120, the electrical lead W is provided with a pair of bare conductor end portions P. The number of end portions P may vary and will depend upon the type of lead or leads being used with the connector. In certain instances, not shown, the outer section of the cover piece may be provided with a plurality of tubular projections, similar to the projections 23*e* shown in FIG. 5, with each projection opening accommodating a separate insulated electrical lead.

The shape of the clip, shield member and cover piece may vary from that shown, and will depend to a large extent on the particular installation in which the connector is to be employed. Thus, it will be seen that an electrical connector for a high voltage circuit has been provided which is of a simple, inexpensive construction; has a minimum number of components which are easy to assemble; and enables a positive and reliable contact to be made with one or more electrical leads without requiring the lead to be soldered or crimped to a component or the insulation of the lead to be pierced by a component of the connector.

I claim:

1. An electrical connector for use with a surface-mounted terminal in a high voltage circuit, the terminal having a recess provided with an inwardly projecting lip deliminating an entry to the recess, said connector comprising a clip of electrically conductive material and having a pair of elongated protruding elements connected at one end by a bail section, the opposite end portions of said elements being free and adapted to extend into the terminal recess entry and make resilient interlocking electrical contact with the terminal lip; an insulated electrical lead having a bare conductor end portion straddled by the coaction of said bail section and adjacent portions of said protruding elements; a shield member having a portion thereof disposed intermediate the protruding elements of said clip and coacting with the clip bail section to resiliently sandwich therebetween the bare conductor end portion of said lead and make electrical contact therewith; and an insulated cover piece accommodating said clip, said shield member, and an insulated segment of the electrical lead and the bare conductor end portion extending therefrom; said cover piece including an inner skirt section encompassing the clip protruding elements and being adapted to overlie and resiliently engage a portion of the surface circumjacent the terminal, and an outer section protruding from said skirt section, said outer section being provided with an interior cavity having an open side adjacent said skirt section, and an opening for accommodating the insulated segment of the electrical lead, said opening having an exposed outer end and a restricted inner end communicating with said cavity; said cavity being provided with protruding means in offset spaced relation relative to the opening inner end and in resilient interlocking engagement with a peripheral portion of said shield member and retaining the bare conductor end portion in resilient sandwiched relation between said shield member and said clip bail section and in electrical contact therewith.

2. The electrical connector of claim 1 wherein the surface of the cavity opposite the open side thereof is provided with a recess in which the clip bail section is disposed.

3. The electrical connector of claim 1 wherein the shield member is of electrical conductive material and is provided with an angularly offset peripheral portion resiliently engaging in interlocking relation the cavity protruding means.

4. The electrical connector of claim 3 wherein the shield member has an inverted substantially saucer configuration including a base portion and an offset rim portion; said base portion being provided with spaced openings through which the clip protruding elements extend; the rim portions being in resilient interlocking engagement with the cavity protruding means.

5. The electrical connector of claim 3 wherein the cavity protruding means is disposed intermediate the opening inner end and the cavity open side.

6. The electrical connector of claim 5 wherein the cavity protruding means is an annular inwardly extending edge delimiting substantially the open side of the cavity adjacent the skirt section.

7. The electrical connector of claim 5 wherein the cavity is provided with a second protruding means angularly disposed relative to the first mentioned protruding means, said second protruding means engaging a predetermined peripheral portion of said shield member, when the latter is in resilient interlocking engagement with the first mentioned protruding means, and restraining relative turning movement of said shield member with respect to said cover piece.

8. The electrical connector of claim 7 wherein the second protruding means of said cavity engages a slot formed in the periphery of said shield member.

9. The electrical connector of claim 1 wherein the bail section of the clip is provided with an integral protuberance which projects through a void formed in the shield member, said protuberance being substantially encircled by the bare conductor end portion, when the latter is resiliently sandwiched between the clip bail section and the shield member.

10. The electrical connector of claim 9 wherein the protuberance encircled by the bare conductor end portion is struckout from the clip bail section and is disposed in spaced relation between the protruding elements of said clip.

11. The electrical connector of claim 1 wherein the bail section of the clip includes a tine disposed intermediate the protruding elements, said tine being in electrical contact with the bare conductor end portion when the latter is resiliently sandwiched between the clip bail section and said shield member.

12. The electrical connector of claim 11 wherein a portion of the shield member in proximity to the tine of the clip is provided with an aperture in which a segment of the bare conductor end portion is exposed.

13. The electrical connector of claim 12 wherein the portion of the shield member intermediate the clip protruding elements is in spaced proximate relation with the clip tine and urges the bare conductor end portion into electrical contact with the tine.

14. An electrical connector for use with a surface-mounted terminal in a high voltage circuit, the terminal having a recess provided with an inwardly projecting lip delimiting an entry to the recess, said connector comprising a clip of electrically conductive material and having a pair of elongated protruding elements connected at one end by a bail section, the opposite end portions of said elements being free and adapted to extend into the terminal recess entry and make resilient interlocking engagement contact with the terminal lip; an insulated electrical lead having a bare conductor end portion straddled by the coaction of said bail section and adjacent portions of said protruding elements; a shield member having a portion thereof disposed intermediate the protruding elements of said clip and coacting with a portion of the clip bail section to resiliently engage therebetween the bare conductor end portion of said lead and make electrical contact therewith, one of the coacting portions engaging the bare conductor end portion being provided with a tine having a sharp edge for engaging the bare conductor end portion; and a low profile insulated cover piece accommodating said clip, said shield member, and an insulated segment of the electrical lead and the bare conductor end portion extending therefrom; said cover piece including an inner skirt section encompassing the clip protruding elements and being adapted to overlie and resiliently engage an exposed portion of the surface circumjacent the terminal, and an outer section protruding outwardly from said skirt section, said outer section being provided with an interior cavity having an open side adjacent said skirt section, and an opening for accommodating the insulated segment of the electrical lead, said opening communicating with said cavity; said cavity being provided with inwardly projecting means offset from said opening and in resilient interlocking relation with an offset peripheral portion of said shield member and retaining the latter in electrical contact with the bare conductor end portion.

* * * * *

UNITED STATES PATENT AND TRADEMARK OFFICE

CERTIFICATE OF CORRECTION

PATENT NO. : 4,566,746

DATED : January 28, 1986

INVENTOR(S) : Ervin J. Hobson

It is certified that error appears in the above-identified patent and that said Letters Patent is hereby corrected as shown below:

Column 4, lines 2 and 22 "23a" should be --23c--.

Column 4, line 33, "FIGS. 8-13" should be --FIGS. 8-12--.

Column 5, line 19, "deliminating" should be --delimiting--.

Column 6, line 58, "engagement" should be --electrical--.

Signed and Sealed this

*Tenth* Day of *June 1986*

[SEAL]

*Attest:*

DONALD J. QUIGG

*Attesting Officer*

*Commissioner of Patents and Trademarks*